US010615013B2

(12) United States Patent
Sampayan

(10) Patent No.: US 10,615,013 B2
(45) Date of Patent: Apr. 7, 2020

(54) LOW TEMPERATURE, PHOTONICALLY AUGMENTED ELECTRON SOURCE SYSTEM

(71) Applicant: Kristin Cortella Sampayan, Manteca, CA (US)

(72) Inventor: Kristin Cortella Sampayan, Manteca, CA (US)

(73) Assignee: Opcondys, Inc., Manteca, CA (US)

( * ) Notice: Subject to any disclaimer, the term of this patent is extended or adjusted under 35 U.S.C. 154(b) by 0 days.

(21) Appl. No.: 16/406,008

(22) Filed: May 8, 2019

(65) Prior Publication Data

US 2019/0355561 A1 Nov. 21, 2019

Related U.S. Application Data

(60) Provisional application No. 62/672,577, filed on May 17, 2018.

(51) Int. Cl.
*H01J 40/06* (2006.01)
*H01J 3/36* (2006.01)

(52) U.S. Cl.
CPC ..... *H01J 40/06* (2013.01); *H01J 3/36* (2013.01)

(58) Field of Classification Search
CPC ..... H01J 40/06; H01J 3/36
See application file for complete search history.

(56) References Cited

U.S. PATENT DOCUMENTS

2010/0139771 A1* 6/2010 Schwede ..... H01J 40/06 136/261
2017/0358432 A1* 12/2017 Wang ..... H01J 40/06
2018/0159459 A1* 6/2018 Mills ..... G21B 3/00

* cited by examiner

*Primary Examiner* — Anne M Hines

(57) ABSTRACT

An electron source system utilizing photon enhanced thermionic emission to create a source of well controlled electrons for injection into a series of lenses so that the beam can be fashioned to meet the particular specification for a given use is disclosed. Because of the recent increased understanding and characterization of the bandgap in certain materials, a simplified system can now be realized to overcome the potential barrier at the surface. With this system, only low electric fields with moderate temperatures (~500 ° C.) are required. The resulting system enables much easier focusing of the electron beam because the random component of the energy of the electrons is much lower than that of a conventional system. The system comprises an emitter of wide bandgap material, a first light source and a heating element wherein the heating element provides moderate warming to the wide bandgap material and the light source provides photonic excitation to the material, causing electrons to be emitted into an optical system to manipulate the emitted electrons.

24 Claims, 6 Drawing Sheets

LOW TEMPERATURE, PHOTONICALLY AUGMENTED ELECTRON SOURCE SYSTEM

TECHNICAL FIELD

This patent relates generally to electron sources used to produce electrons for industrial and scientific purposes.

BACKGROUND

Electron sources are used for industrial and scientific purposes in a wide range of applications such as electron beam welding, medical device sterilization, x-ray imaging, electron microscopy, electron beam lithography, polymer cross-linking, cargo scanning and sterilization. The lack of high-power, robust electron sources that can operate in harsh environments has limited the adoption of electron accelerators for energy and environmental processes such as sterilization of water, wastewater and sludge, decontamination of gas streams, food decontamination, and the polymerization of asphalt roadways. Additionally, precisely focused electron beams are required for state-of-the-art ultra-fast transmission electron microscopy (UTEM) which promises to be one of the most powerful tools for dynamic investigation on the nano-scale. Other RF devices such as gridless Inductive Output Tubes (IOTs) or klystrode type devices benefit from an advanced electron source as well. The ability to emit continuous or finely controlled low emittance electron pulses without a high-power modulator or grid enable greater simplification of electron injectors for accelerator systems.

SUMMARY

The present invention relates generally to electron sources, particularly to an electron source of the gridless type in which electrons are disassociated from a wide bandgap material by exploiting the photon enhanced thermionic emission (PETE) process. The invention employs an external means to create an electric field across the anode-cathode (A-K) gap. Control of the A-K gap electric field may be by the optical transconductance varistor (OTV), a photonically controlled, wide bandgap (WBG), solid state ultra-high voltage series control or other suitable element. The cathode employs WBG material and the PETE process. PETE emission may be enhanced by coating the cathode with a material which lowers the surface work function.

The PETE process is based on vacuum emission of photoexcited electrons that are in thermal equilibrium with a moderately warm semiconductor lattice. The temperature at which emission occurs is significantly below thermionic emitters. Because of this reduced temperature, the random component of energy in the beam is also reduced so as to allow much better focusing of the emitted electrons. Further, because the quantum efficiency can approach unity, much smaller light sources can be used and make the emission of electrons much more efficient. Finally, the materials used in this invention are less susceptible to contamination which prolongs the life of the cathode system

DETAILED DESCRIPTION

Figure 1:
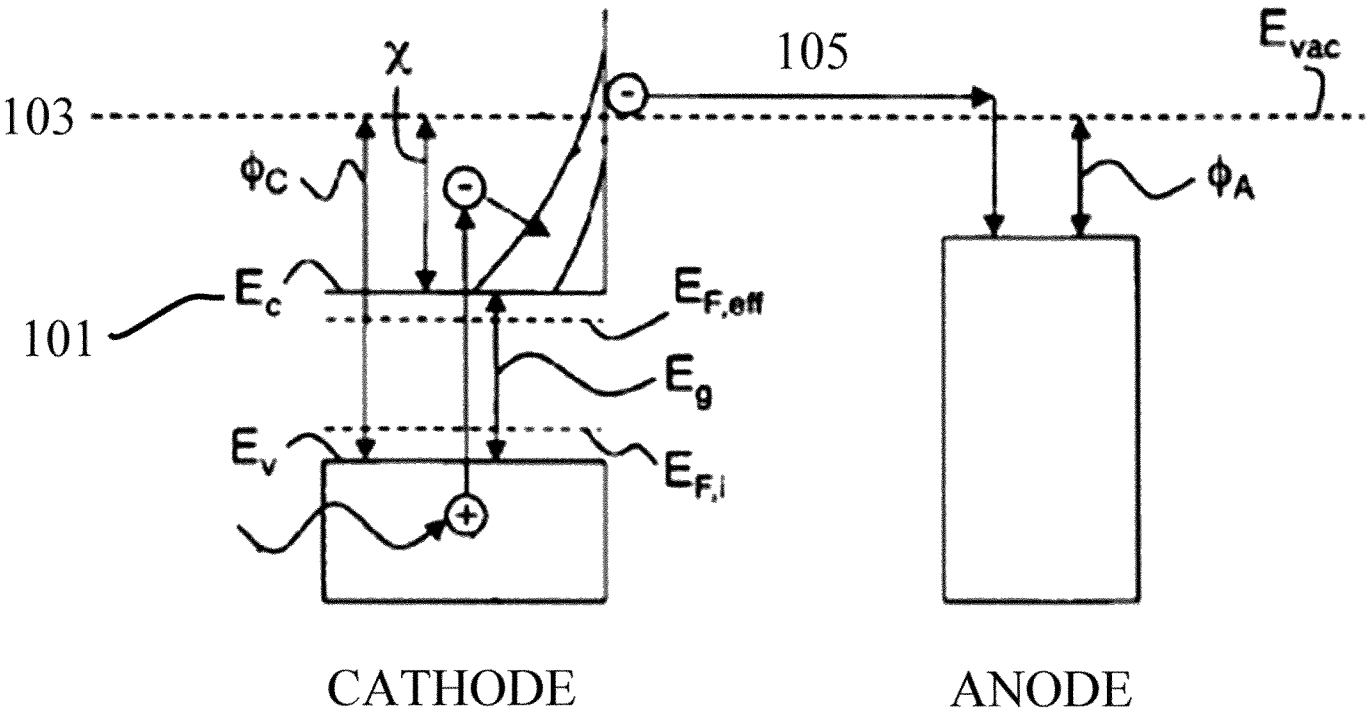
FIG. 1 shows the phenomenology of the photon enhanced thermionic emission (PETE) process.

In this patent document, the word "exemplary" is used to mean serving as an example, instance, or illustration. Any embodiment or configuration described herein as "exemplary" is not necessarily to be construed as preferred or advantageous over other embodiments or configurations. Rather, use of the word "exemplary" is intended to present concepts in a concrete manner.

Emission of electrons from a material employs a wide variety of methods. As is understood by one skilled in the art, a material forming an interface with vacuum cannot emit significant quantities of electrons because of the intrinsic barrier potential. To overcome this barrier, either a very large electric field must be applied or heating of the material to one to two thousand degrees is required. But once the electrons are created, they are usually injected into a combination of drift spaces and lenses consisting of electric fields, magnetic fields, or a combination of the two, so that the beam can be fashioned to meet the particular specification for the given use. Usually this requirement is to focus the electron beam to as small of focal spot as possible. Typically, these beams can have a focal spot of much less than 1 mm. Unfortunately, these lens systems can only be readily optimized for a very narrow distribution of electron energies. For instance, if the beam of electrons has a random distribution of energy in any direction (i.e., emittance), the system of lenses that can be easily implemented cannot be adjusted so as to accommodate that distribution. The resultant effect is a poorly focused beam. Thus, a technique needs to be implemented that minimizes the random distribution of energy for the electrons emitted into the vacuum.

Field electron emission is induced by a very high electric field. This electron source requires electric fields of gradients typically greater than 1 gigavolt per meter. An example of an application for surface field emission include bright electron sources for high-resolution electron microscopes. The fields required to induce field emission are strongly dependent upon the emitting material's work function. Nonetheless, these fields are so high that breakdown and reliability problems are often issues to overcome to achieve a reliable system. To achieve adequate electron emission, often highly sharpened tips are used. The difficulty with this approach is that the because of the local shape of the electric field and the effect on the trajectory of the electrons, an "effective" random component of energy is created in the electrons such that focusing is difficult.

Thermionic electron sources produce a flow of charge carriers from a surface by increasing their thermal energy to overcome the work function of the source material. The classical example of thermionic emission is that of electrons from a hot cathode in a vacuum tube. The hot cathode can be a metal filament, a coated metal filament, or a separate structure of metal or carbides or borides of transition metals.

The magnitude of the charge flow increases dramatically with increasing temperature. Thermionic electron sources must operate at temperatures above 1400° C. They have short lifetimes on the order of 100's of hours and are subject to contamination from the residual molecules in the vacuum. But again, these high temperatures create a random energy component in the electrons that are emitted so that focusing is difficult.

Photonic electron emission due to the photoelectric effect occurs when light strikes a material surface. Energy from photons is transferred to surface electrons which gain sufficient energy to overcome the barrier potential at the material-vacuum interface. Once exceeded, electrons are emitted from the material surface. Standard photo-emitter electron sources have low quantum efficiency (QE). QE is as low as 0.013% (i.e., electrons per photon) at 80° C. for aluminum doped SiC and as high as 0.325% for boron doped polycrystalline diamond. The QE of metal cathodes is typically between these values. With such low efficiencies, photo-emitter electron injector systems require large and complex laser systems which negate the advantages of a photocathode system.

The photon enhanced thermionic emission (PETE) process was implemented to increase the efficiency of photovoltaics (PV) by combining the photoelectric effect with waste heat into a single package. PETE takes advantage of both the high per-quanta energy of photons and the available thermal energy due to thermalization and absorption losses. Thus the PETE process is a means to scavenge waste heat in PV cells to increase the net efficiency of the overall device. The potential developed across the PV device results from the physical effects and work functions of the surfaces combined within the device. It was only after careful consideration of the physics of the PETE process by itself, the characteristics of the electrons emitted, and their application to scientific and industrial electron beams, did the present invention heretofore result.

FIG. 1 shows the PETE phenomenology. The photonic process excites electrons into the conduction band 101. Added thermal energy combines with the photo-excitation to exceed the surface work function 103 to emit electrons off the surface and into a vacuum gap 105. In the PV application, heat comes from the inefficiency of the solar to electricity conversion process. The emitted electrons are then collected by an anode and the resulting electrical current is used to power electrical devices. In the present invention, an external heat source is intentionally applied. The emitted electrons are injected into an accelerator, klystrode or other similar device and used for a wide variety of industrial, commercial and scientific uses.

Figure 2:
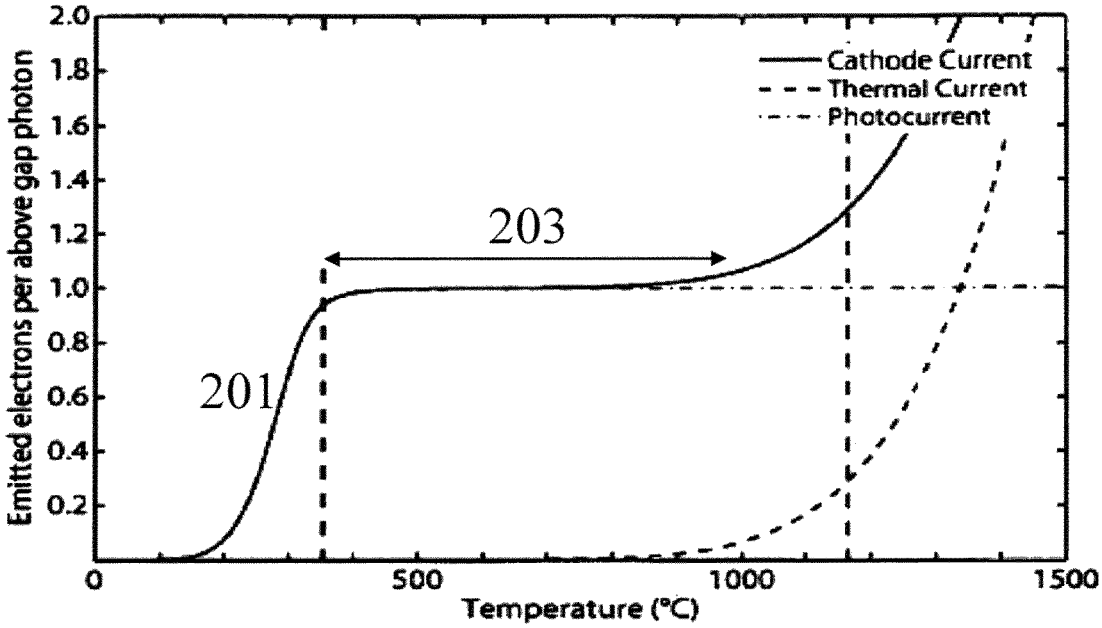
FIG. 2 shows the temperature dependent performance of the PETE process.

FIG. 2 shows the PETE process as a function of temperature. The "photoemission regime" 201 relies on carrier excitation from the valance band. From about 200° C. to about 700° C., the contribution from the thermal component begins and reaches a plateau in "photon enhanced thermionic regime" 203. Beyond that temperature, thermionic emission begins to dominate. It is in this latter region that significant amounts of random thermal energy is added to the electrons making focusing difficult.

The benefit of this process is that with modest temperatures of only 400° C. to 700° C., it is possible to achieve near unity QE for electron sources using wide band-gap (WBG) materials for the cathode. Since the emittance for a thermionic process goes as $T^{0.5}$ (where T is the temperature), the lower temperatures of the PETE process yields an emittance estimated to be 1.5-2× lower compared to standard thermionic cathodes, making focusing much easier.

Figure 3:
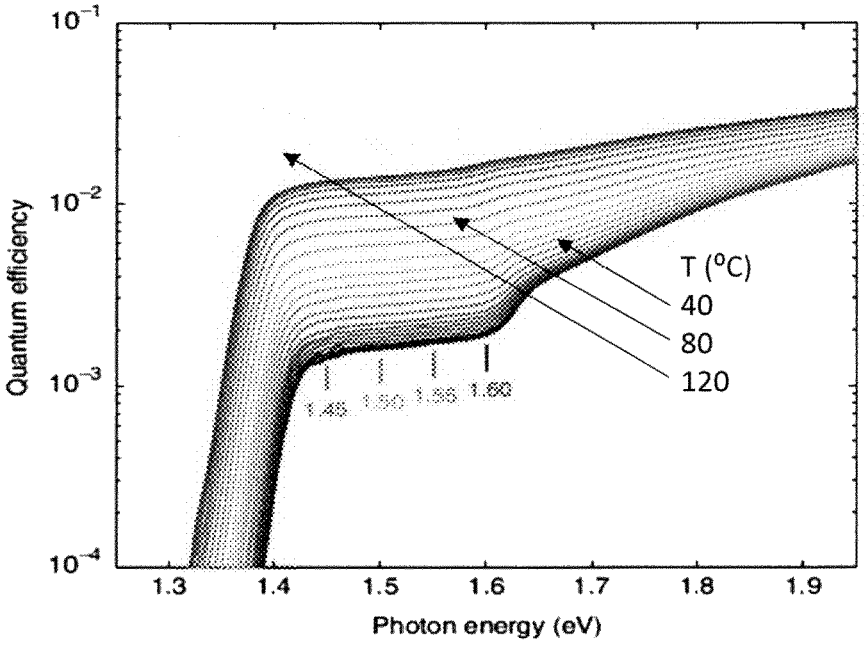
FIG. 3 shows the relationship of quantum efficiency to temperature and photon energy of an emitter with $Al_{0.15}Ga_{0.85}As$ surface and cesium oxide layer to lower the surface work function.

FIG. 3 shows the effect of applying a work function lowering material to the cathode surface. In this example, an $Al_{0.15}Ga_{0.85}$ As emitter surface with a cesium oxide layer lowers the surface work function. At a photon energy greater than the emitter bandgap (E~1.6 eV), the quantum efficiency increases by almost an order of magnitude when the temperature is raised from 40° C. to 120° C. Lowering the surface work function further reduces the temperature requirement and makes the emittance even lower.

The addition of a heteroepitaxial layer of aluminum nitride (AlN) on 6H—SiC produces a negative electron affinity. Unlike a typical dispenser cathode that can be easily poisoned because of the high reactivity of the materials used, AlN is stable in air to 700° C. and in vacuum to 1800° C. An n-type emitter pulsed by a modest optical energy from a Nd:YAG laser with a 1 mm spot provides an optical intensity of ~150 MW-cm$^{-2}$, well below the damage threshold of SiC of 80 GW-cm$^{-2}$. Such a system delivers a peak current of >300 A-cm$^{-2}$. This current exceeds most requirements for industrial electron sources. Because both the SiC cathode material and AlN coating are inert, the cathode is extremely robust compared to existing technologies. Thus, coating the cathode with an AlN layer lowers the surface work function, lowering the temperature requirement and emittance while also being robust.

Figure 4A:
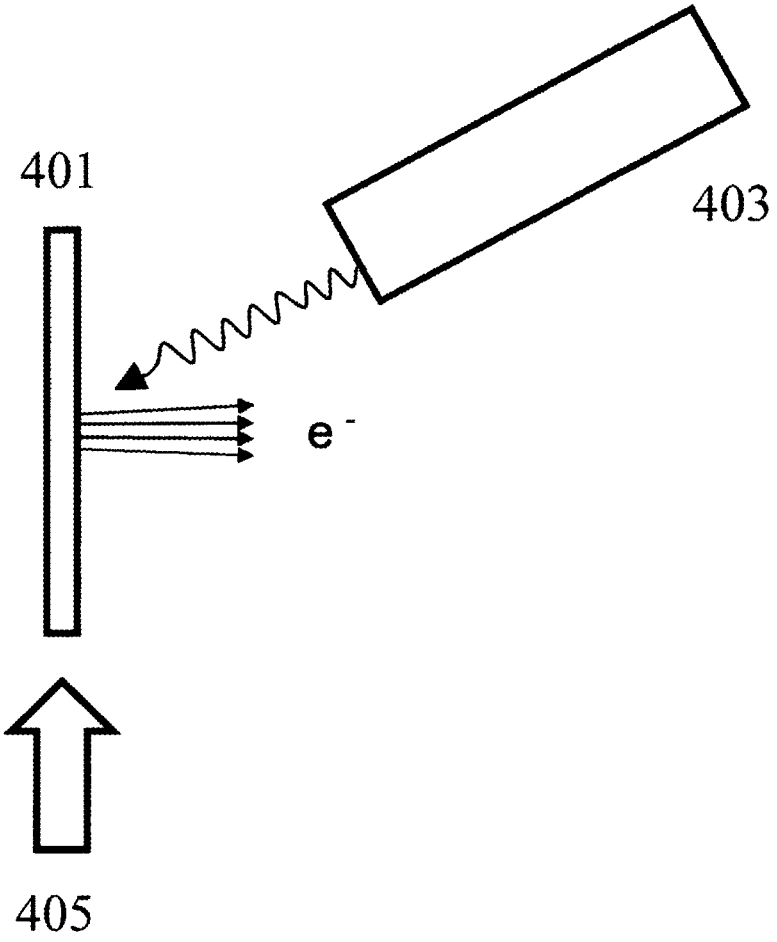
FIGS. 4A and 4B show exemplary diagrams of the present invention.
Figure 4B:
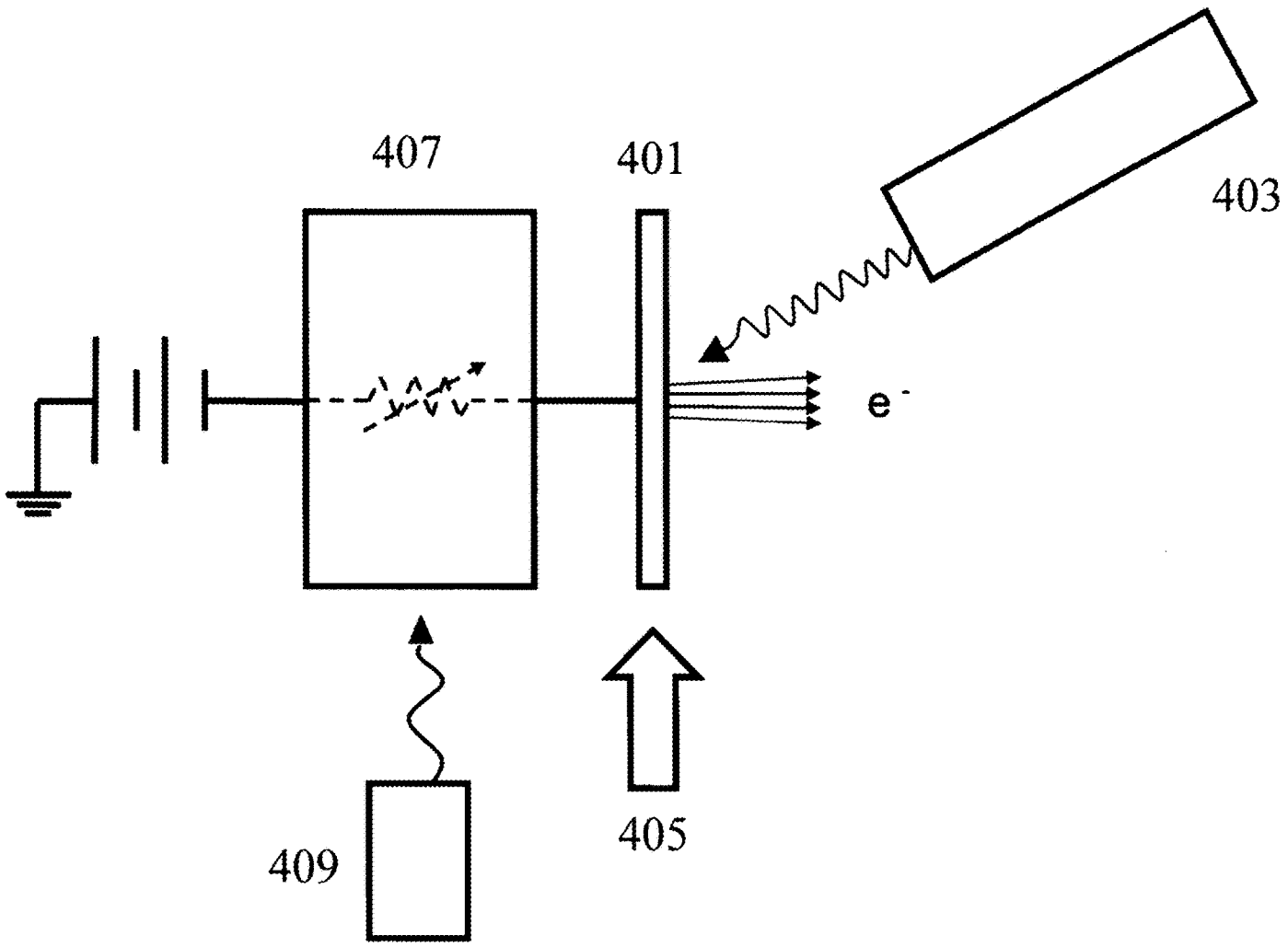

FIG. 4A and FIG. 4B show the present invention. The emitter 401 is SiC which has a bandgap of approximately 3 eV (413 nm) depending on the polytype. In some embodiments, the emitter may be coated with a work function reducing material. A 355 nm wavelength laser 403 photo-excites electrons into the conduction band from the valance band. A heat source 405 heats the substrate to moderate temperature to enable the PETE process. An externally applied electric field 406 aides to keep the electrons constrained by adding increased momentum in the emitted direction. Close to unity QE is the object. In some embodiments, the A-K gap potential is enabled by the OTV 407, a photonic, wide bandgap, bulk conduction power electronic device. The OTV is controlled by a second light source 409, typically 532 nm. The light source operates the OTV at nanosecond timescales. Thus, this present invention is a highly efficient, robust, electron source that allows micro-managing electron beam characteristics.

Figure 5:
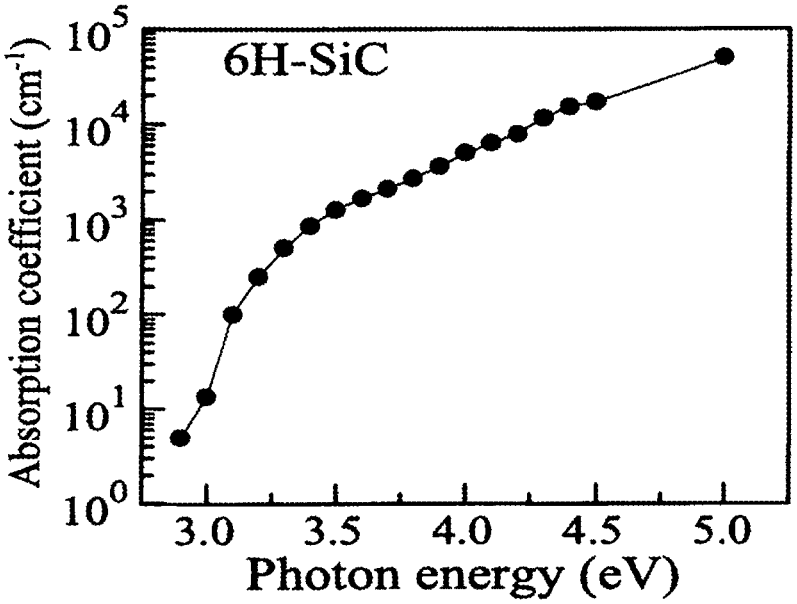
FIG. 5 shows the absorption curve for 6H silicon carbide.

FIG. 5 shows a typical absorbance curve for 6H SiC. The advantage of photoexciting a SiC emitter with 355 nm wavelength light is that the absorption depth is roughly 10 μm. Much of the energy is deposited in a thin surface layer, making efficient use of the light in a face-pump configuration. Using a second light source to side pump the OTV with below bandgap light, where the absorption depth is on the order of centimeters, bulk conductivity to the power supply can be controlled so that with a combination of face and side-pump light sources, the energy and current density can be controlled actively without a grid. Laser diodes of 445 nm may also be used as the second light source because their upper modulation frequency limit extends into the GHz regime.

Figure 6:
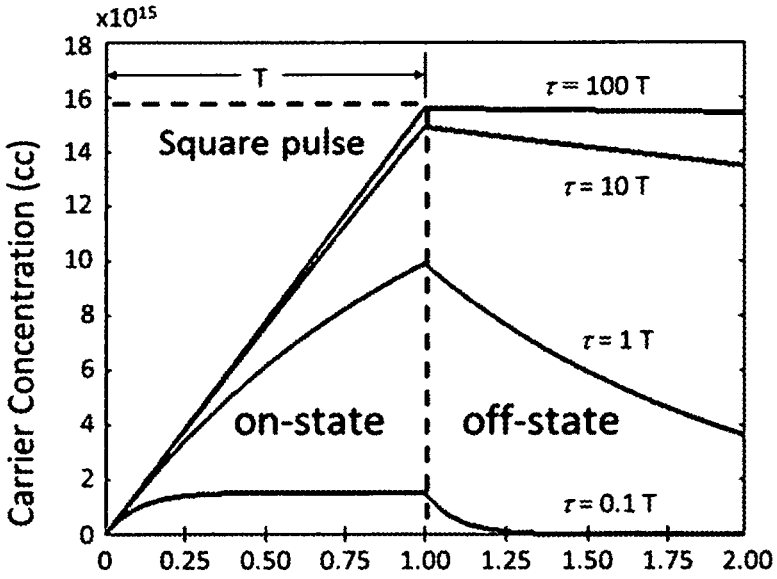
FIG. 6 shows the carrier excitation response to an idealized rectangular laser pulse.

FIG. 6 shows the overall photonic control response. The time response of the OTV is dependent on the doping. This effect is due to the carrier excitation time and subsequent decay. Essentially, carriers can be optically excited from the valance band or deep levels within the bandgap. Data shows that excitation is very fast (<1 ps). Once excited, the carriers decay according to Shockley-Read-Hall (SRH) recombination. In the simplest form, the behavior of the carrier population in the conduction band or conductivity is:

$$g(t) \propto e^{-\frac{t}{\tau}} \int_0^t S(t')e^{\frac{t'}{\tau}} dt'$$

where: τ—carrier recovery time and S(t)—normalized laser intensity.

For a rectangular laser pulse and a short recombination time, the carrier concentration is low, but the fidelity is high. Conversely, for a long recombination time, the carrier concentration is high and the fidelity is low. This recombination time can be controlled by the concentration of the deep levels within the bandgap. Vanadium is used as the dopant to create these deep levels. Recombination times can be tailored from less than 35 ps to about 5 ns for vanadium concentrations of about $2\times10^{17}$ $cm^{-3}$ to $1\times10^{15}$ $cm^{-3}$. Such a range allows designing the material to have a response over a very wide range of frequencies.

Another aspect that vanadium introduction into the lattice produces is a mid-bandgap state that electrons can occupy. The energy level is 1.55 eV and 1.57 eV. What these sites allow is the ability to excite the electrons into the conduction band with lower energy light. For the present invention, a laser wavelength of 532 nm (2ω for an Nd:YAG laser) is more than adequate to stimulate electron emission. This further reduces the emittance by the square root of the ratio of the energy level difference.

The elegance of this invention is that the valence band versus the deep level base process of photoexcitation of electrons into the conduction band serves both the PETE and the OTV processes. The end result is controlled surface emission in the PETE process and bulk conduction in the OTV process.

Figure 7:
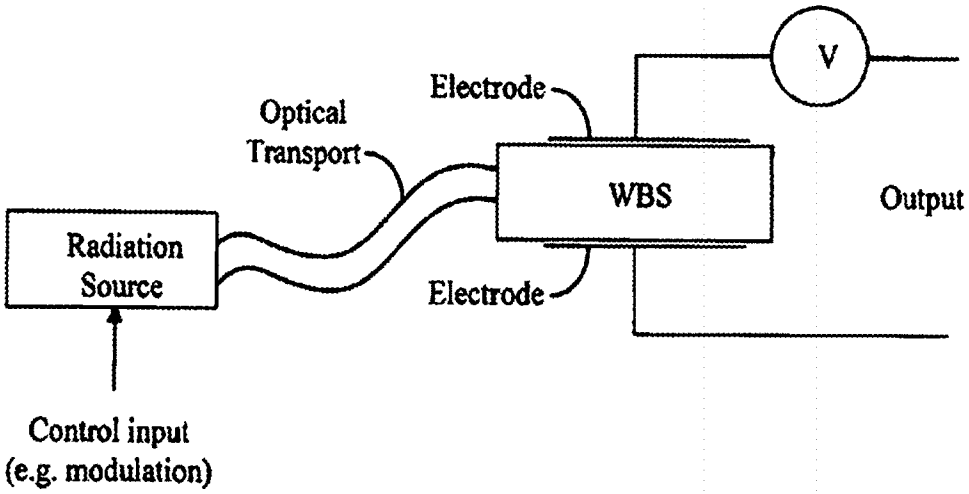
FIG. 7 shows the optical transconductance varistor which provides control of the anode-cathode potential in the present invention.

FIG. 7 shows the OTV. The OTV is similar to a high voltage MOSFET except it is controlled photonically and is orders of magnitude faster. By exploiting the relatively weak optical absorption of below bandgap excitation in WBG semi-insulating materials, a high voltage, photonically controlled bulk conduction device without an intervening control junction is enabled. Its performance significantly exceeds that of existing junction devices. Bulk conduction eliminates the transit-time effect so that the fundamental figure of merit can be exceeded; optical intensity and carrier recombination time (intentionally controlled by introducing mid-bandgap trapping sites) enables linear current control. This latter property manifests itself as a transconductance like control behavior similar to junction devices and enables precise current control in the present invention.

Junction devices control current with an intervening control junction near the input source side of the device. Carrier transit time between the input and output through this volume defines the metric of performance which includes switching speed, transition speed, and power loss and is called the figure of merit (FOM). For transition loss, the most relevant FOM=$E_c$ $v_s$/2n where $E_c$—critical electric field for carrier avalanche and $v_s$—carrier drift velocity) With limited drift velocities in SiC (<$10^7$-cm-$s^{-1}$), the ability to simultaneously control carriers in the bulk material between input and output electrodes provides equivalent "drift velocities" of $v_s$~c (e.g., the speed of light). Photonic excitation enables this conduction mechanism and minimizes the inefficiencies of existing SiC junction devices while maintaining electrical isolation.

The advantage of bulk conduction is that the applied potential is evenly distributed across the entire thickness of the substrate. This effect is unlike a standard junction device where the potential is distributed across a thin depletion region or drift layer depending on carrier density. Based on the capability of SiC (>95-kA/$cm^2$ pulsed current densities and ~2400 to 5000-kV/cm breakdown electric field), a linear, transistor-like property at extremely high power densities (~TW/$cm^3$) is enabled leading to precise control of the electron emission in the present invention.

While this patent document contains many specifics, these should not be construed as limitations on the scope of the invention or of what is claimed, but rather as descriptions of features that may be specific to particular embodiments of the inventions. Certain features that are described in this patent document in the context of separate embodiments can also be implemented in combination in a single embodiment. Conversely, various features that are described in the context of a single embodiment can also be implemented in multiple embodiments separately or in any suitable sub-combination. Moreover, although features may be described as acting in certain combinations and even claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

I claim:

1. An electron source comprising

A wide bandgap emitter,

A means for applying an electric field in proximity to the emitter surface,

A heat source to warm said emitter to moderate temperature, and

A light source to illuminate said emitter to liberate electrons within the Photon Enhanced Thermionic Emission Region.

2. The electron source of claim 1 where the emitter material is silicon carbide.

3. The electron source of claim 1 where the emitter is coated with a material which reduces the surface work function.

4. The electron source of claim 3 where the material which reduces the surface work function is aluminum nitride (AlN).

5. The electron source of claim 1 where the emitter and OTV are of a single piece of wide bandgap material.

6. The electron source of claim 5 where the wide bandgap material is silicon carbide.

7. The electron source of claim 5 where the emitting surface of the single piece of wide bandgap material is coated with a material which reduces the surface work function.

8. The electron source of claim 7 where the material which reduces the surface work function is aluminum nitride (AlN).

9. An electron source comprising

A wide bandgap material emitter,

A heat source to warm said emitter to moderate temperature, and

A light source to illuminate said emitter to liberate electrons within the Photon Enhanced Thermionic Emission Region, wherein the electrons are injected into a beam transport system comprising a combination of a drift space and lens consisting of an electric field, a magnetic field, or a combination thereof, so that the beam can be fashioned to meet the particular specification for a given use.

10. The electron source of claim 9 where the emitter material is silicon carbide.

11. The electron source of claim 9 where the emitter is coated with a material which reduces the surface work function.

12. The electron source of claim 11 where the material which reduces the surface work function is aluminum nitride (AlN).

13. The electron source of claim 9 where the emitter and OTV are of a single piece of wide bandgap material.

14. The electron source of claim 13 where the wide bandgap material is silicon carbide.

15. The electron source of claim 13 where the emitting surface of the single piece of wide bandgap material is coated with a material which reduces the surface work function.

16. The electron source of claim 15 where the material which reduces the surface work function is aluminum nitride (AlN).

17. An electron source comprising

A wide bandgap material emitter,

A heat source to warm said emitter to moderate temperature,

A light source to illuminate said emitter to liberate electrons within the Photon Enhanced Thermionic Emission Region, A voltage source to provide the anode-emitter gap potential, An optical transconductance varistor (OTV) to control anode-emitter gap potential, and A second light source to control said OTV, wherein the electrons are injected into a beam transport system comprising a combination of a drift space and lens consisting of an electric field, a magnetic fields, or a combination thereof, so that the beam can be fashioned to meet the particular specification for a given use.

18. The electron source of claim 17 where the emitter material is silicon carbide.

19. The electron source of claim 17 where the emitter is coated with a material which reduces the surface work function.

20. The electron source of claim 19 where the material which reduces the surface work function is aluminum nitride (AlN).

21. The electron source of claim 17 where the emitter and OTV are of a single piece of wide bandgap material.

22. The electron source of claim 21 where the wide bandgap material is silicon carbide.

23. The electron source of claim 21 where the emitting surface of the single piece of wide bandgap material is coated with a material which reduces the surface work function.

24. The electron source of claim 23 where the material which reduces the surface work function is aluminum nitride (AlN).

* * * * *